US006244090B1

(12) United States Patent
Le Viavant

(10) Patent No.: US 6,244,090 B1
(45) Date of Patent: Jun. 12, 2001

(54) ROLL MILL WITH BENDING MEANS FOR THE WORKING ROLLS

(75) Inventor: Germain Le Viavant, Beauchamp (FR)

(73) Assignee: Via Clecim, Cedex (FR)

( * ) Notice: Subject to any disclaimer, the term of this patent is extended or adjusted under 35 U.S.C. 154(b) by 0 days.

(21) Appl. No.: 09/449,640

(22) Filed: Nov. 30, 1999

(30) Foreign Application Priority Data

Nov. 30, 1998 (FR) ..... 98 15077

(51) Int. Cl.[7] ..... B21B 31/07; B21B 13/14
(52) U.S. Cl. ..... 72/241.8
(58) Field of Search ..... 72/241.8, 241.4, 72/241.6, 243.2

(56) References Cited

U.S. PATENT DOCUMENTS

| | | | | |
|---|---|---|---|---|
| 4,369,646 | * | 1/1983 | Kajiwara | 72/241.8 |
| 6,029,491 | * | 2/2000 | Ginzburg | 72/247 |
| 6,073,474 | * | 6/2000 | Dittmar | 72/241.8 |

FOREIGN PATENT DOCUMENTS

| | | |
|---|---|---|
| 0 286 533 | 10/1988 | (EP) . |
| 2 263 876 | 8/1993 | (GB) . |
| 64-5612 | 1/1989 | (JP) . |

OTHER PUBLICATIONS

Patent Abstracts of Japan, vol. 008, No. 005, Jan. 11, 1984 & JP 58–168407 (Hitachi Seisakusho KK), Oct. 4, 1983.
Patent Abstracts of Japan, vol. 015, No. 045, Feb. 4, 1991 & JP 02–280910 (Kawasaki Steel Corp.), Nov. 16, 1990.

* cited by examiner

*Primary Examiner*—Rodney A. Butler
(74) *Attorney, Agent, or Firm*—Arent Fox Kintner Plotkin & Kahn, PLLC

(57) ABSTRACT

A roll mill comprising a retaining stand with two distant stanchions (1, 1*b*), at least two working rolls (2, 2') each rotating respectively in two chocks, and means for applying bending loads to each end of both working rolls, said means comprising, for both chocks (4, 4'), two sets of, respectively, positive and negative bending jacks. According to the invention, both working rolls (2, 2') of said roll mill are fitted with identical chocks (4, 4') capable, by simple turning-over, to be mounted on either of the said working rolls (2, 2'), each chock having, on each side of the clamping plane (P2), a lug (7) with a staggered profile comprising at least one bearing part (73*a*) extending over a portion only of the length of the chock (4) so as to provide at least one free space (74*a*), and each negative bending jack (6) of a first chock (4) is placed on the same side of the rolling plane (P1) as the positive bending jack (5') of the second chock (4'), which crosses the rolling plane (P2) passing through the said free space (74*a*) left beside the bearing part (73*a*) of the first chock (4).

4 Claims, 4 Drawing Sheets

ROLL MILL WITH BENDING MEANS FOR THE WORKING ROLLS

Rolling band-type metal products takes normally place in a roll mill train, wherein each mill is composed of a stand comprising two supporting stanchions, spread apart from one another and linked by crossbeams, between which is installed a set of superimposed rolls with parallel axes and located more or less in the same clamping plane, more or less perpendicular to the running direction of the product.

Roll mills of different types can be realised. Generally, in a roll mill, the product to be rolled runs between two working rolls that delineate the rolling plane; these rolls are generally of small diameter with respect to the loads to which they will be subjected, they rest therefore generally on at least two backup rolls between which the rolling load is applied.

The so-called 'quarto'-type roll mills comprise therefore four superimposed rolls, respectively two working rolls connected to respectively two back-up rolls of larger diameter.

In 'sexto' roll mills, intermediate rolls are interposed between each working roll and the corresponding back-up roll.

Other mill types, comprising more or fewer rolls are known and used in the industry.

The rolls bear upon one another along more or less parallel bearing lines, and directed along a generatrix whose profile, normally rectilinear, depends on the loads exerted and on the resistance exhibited by the rolls. Generally, the clamping load is applied by screws or jacks interposed between the stand and the ends of the shaft of the upper back-up roll, whereas the lower back-up roll bearing directly upon the stand with its ends. Apart from the latter roll, the other rolls must therefore be able to move with respect to the stand and, to this end, they are carried by supporting members, mounted to slide vertically in two windows provided in both stanchions of the stand.

Clamping means, such as screws or jacks, bearing upon the stand, exert a vertical load in order to tighten the rolls in order to roll the product running between the working rolls.

Generally, each roll is mounted to rotate round its axis, on bearings carried by two supporting members, called chocks, and these chocks are mounted to slide parallel to the clamping plane running through the axes of the working rolls, each chock sliding between two plane guiding faces provided respectively on either side of the clamping plane on both sides of the corresponding window of the stand.

The clamping loads are applied between both ends of the back-up rolls. Since the rolled product, with variable width, does not cover the length of the working rolls totally, each roll may warp due to the loads applied.

The result is a variation in thickness of the running space of the band between the working rolls, whereas the edges of the band can be thinner than the central portion.

For some time, efforts have been directed to correcting these defects in thickness on the profile across the rolled product and various means have been used for this purpose.

For example, it has been suggested to compensate for the deformation of the rolls due to the rolling effort by vaulting their surfaces, thereby machining the surfaces to a particular profile. This solution exhibits the shortcoming of not perfectly suiting all the widths of the rolled product. Moreover, the defect in thickness on the profile across the rolled product is complex since it is the result of all the deformations of all the rolls that are of different diameters and of the deformation of all the constitutive parts of the roll stand under the loads applied.

Therefore, it has also been suggested to perform adjustable correction continuously, by bending the working rolls, which are generally of small diameters, while applying controlled flexion loads to both ends of their shafts.

To this end, hydraulic jacks are usually placed on either side of each chock and they bear on a fixed portion in one direction and on protruding lateral sides on the other, thereby forming bearing lugs for the chock.

This arrangement therefore enables producing so-called negative bending, by tightening the chocks of both working rolls, in order to compensate for excessive thickness of the edges of the product or so-called positive bending, by spreading the chocks of both working rolls apart in order to compensate for excessive thickness of the central portion of the product.

In order to reduce the number of jacks, it may be contemplated to use double-action jacks producing positive bending in one direction and negative bending in the other. Then, the stems of the jacks must be connected to the chock in both directions. However, the rolls must be replaced periodically and, to this end, are removed from the stand by moving parallel to their axis while sliding or running on rails. The bending jacks must then be removed at the same time as the chocks or the bending load must be applied to intermediate parts upon which the chocks are bearing with a possibility of axial sliding.

Such an arrangement is rather complicated and, generally, single-action jacks are used preferably, whereas the jacks act in opposite directions on the chocks, respectively for positive bending and for negative bending of the roll. To do so, the positive bending jacks can be simply interposed between the chocks of both working rolls, respectively the upper and the lower rolls, while bearing upon the chocks in opposite directions. However, the load exerted on both rolls, on either side of the rolling plane, can only be symmetrical.

It is therefore preferable to use jacks connected to each chock in order to apply individually specific bending loads to each working roll. However, such an arrangement increases, obviously, the number of the jacks and makes their installation more complicated, in particular for positive bending jacks which are placed between the chocks.

Moreover, since the diameter of the working rolls is rather small, their chocks are smaller still than those of the back-up rolls. It thus seems natural that, in order to adjust the levels of the working chocks, to bear upon the backup rolls, whereas the latter can be prolonged by guiding legs between which the working chocks are mounted to slide.

However, the level of the back-up chocks can vary and, to ensure accurate control of the profile of the working rolls, it is preferable that the bending jacks bear directly upon the stand.

To this effect, it is more advantageous to install the bending jacks in two supporting parts, provided respectively on both sides of each window of the stand at the level of the working rolls and inside which are fitted the hydraulic systems, whereas these supporting parts will often be called, for this reason, 'hydraulic blocks.'

Usually, the positive and negative bending jacks are located in bearing sections extending and protruding inside the window and fitted, at their ends, with lateral faces for guiding the chock, whereas the lugs of the faces extend to the outside between the said protruding sections.

Therefore, each supporting block usually comprises three protruding sections, respectively a central section placed at the level of the rolling plane, in which are located the positive bending jacks of both chocks and two upper and lower sections placed, respectively, above and beneath the rolling plane and in which are located the negative bending jacks of both jacks, respectively upper and lower.

As can be seen on FIG. 1 which shows, for exemplification purposes, an arrangement of such type, each supporting block, therefore exhibits an E-shape comprising, on either side of the central protruding section, two recesses into which extend, respectively, the lugs of both chocks. These recesses must therefore be of sufficient height to enable varying the relative levels of the rolls.

However, the rolls of a mill and, in particular, the working rolls, wear rather rapidly and their diameter may therefore vary, as well as obviously, the relative positions of the rolls applied one over the other. FIG. 1 shows, for example, the relative positions of the new and worn rolls, respectively on the right and on the left of the clamping plane. It results that the heights of the guiding faces and the strokes of the jacks must be increased in relation to the wearing range in order to enable the necessary height adjustment of the rolls.

Moreover, the rolls can only be dismantled in a determined position that corresponds to the level of fixed sliding rails of the chocks and, in this position, all the rolls must be spread apart from one another. Still, usually, the bending jacks are used for balancing the weight of the working rolls and of all their chocks and must therefore carry the rolls over the whole adjustment stroke from the dismantling position to the tightest position of the chocks.

For all these reasons, the length of the positive bending jacks, as well as the height of the recesses in which extend the lugs of the chocks, must be sufficient to ensure the necessary stroke.

It results that the total height of the hydraulic blocks must be relatively important and it is therefore necessary to have sufficient space between the chocks of the back-up rolls in order to place the hydraulic blocks there. This makes the installation of the bending system more complicated when modernising an existing stand and in the case of a new stand, these requirements increase the sizes of the stand and, consequently, the cost of the stand.

It appears therefore that the design of a new roll mill stand or the adaptation of bending systems to an existing stand must take into account a set of requirements that can be sometimes conflicting while aiming, obviously, at reducing the global cost of the stand and enabling adjusting the profile of the rolls as accurately as possible.

Moreover, to determine the sizes and the installation of the hydraulic blocks, the jacks and the bearing lugs, a set of parameters associated with the operating conditions must be taken into account. For example, the rolling plane must be placed, normally, at more or less constant level and, as shown on FIG. 1, respectively for the upper working roll and for the lower working roll, special chocks should be used, with lateral guiding faces extended downwards to ensure correct guiding over the whole necessary height, taking into account the wearing range.

Such an arrangement cannot be symmetrical and two types of chocks must therefore be available, respectively for the upper rolls and the lower rolls. During replacement, the new rolls must be fitted in advance with the suitable chocks in relation to their position in the stand, respectively above and beneath the rolling plane.

The invention therefore seeks to solve all these problems while avoiding the shortcomings mentioned above, thanks to a new arrangement of the chocks and of the bending jacks which enable using, for the working rolls, chocks of a single model, whereas these chocks can be suited either to an upper roll or to a lower roll, simply by turning them over.

Moreover, the arrangement according to the invention enables reducing the height of the supporting blocks and simplifying their installation.

The invention therefore relates, generally, to a roll mill of known type, comprising two sets of jacks located on either side of the clamping plane and acting respectively on two bearing lugs of the chock of each working roll, respectively upper or lower roll, whereas each set of bending jacks comprises at least two positive bending jacks bearing, respectively, upon the internal faces of the lugs of both chocks and at least two negative bending jacks bearing, respectively on the external face of the lugs of both chocks, whereby the negative bending jacks of a first chock and the positive bending jacks of the second chock exhibit fixed elements of the same side of the rolling plane and mobile elements bearing, respectively, on the external face of the bearing lug of the first chock and on the internal face of the bearing lug of the second chock, whereas the mobile elements of the positive bending jacks of the second chock running through the lugs of the first chock.

According to the invention, the chocks of both working rolls are identical and may, by simple turning over, be installed on either of the rolls, and the bending jacks, respectively positive and negative of both chocks are centred respectively in two planes parallel to the clamping plane and are located symmetrically with respect to a central axis of symmetry placed in the clamping plane, wherein each lug of a first chock exhibits a staggered profile comprising at least one bearing section extending, in the longitudinal direction of the axis of the roll, on one section only of the length of the chock in order to provide at least one free running space of the mobile element of at least one positive bending jack of the second chock. On a same clamping plane, the staggered profiles of the lugs, respectively, of both chocks are reverted so that a bearing section of a first chock matches a free space of the second chock and, on a same clamping plane, the staggered profiles of the lugs of a given chock placed respectively on either side of the clamping plane are reverted so that each bearing section of a lug of the chock placed on one side of the clamping plane is symmetrical with respect to the central axis, by a free space of the lug of the same chock placed on the other side of the clamping plane.

In the usual case of a roll mill comprising two working rolls, respectively upper and lower rolls, placed on either side of a rolling plane that is more or less horizontal, each supporting block comprises an upper retaining section in which are installed the fixed elements of the negative bending jacks of the upper working roll and of the positive bending jacks of the lower working roll and a lower retaining section in which are installed the fixed elements of the negative bending jacks of the lower working roll and of the positive bending jacks of the upper working roll.

Thanks to the invention, both working rolls of a roll mill stand and, even, of all the stands in a tandem roll mill, can be fitted with chocks of a single model.

But the invention also enables facilitating the integration of the bending system in the stand.

Indeed, according to another particularly advantageous characteristic, the fixed elements of the bending jacks, respectively positive and negative jacks, of both chocks are installed respectively in protruding sections of both supporting blocks fixed respectively on each stanchion of the stand, on either side of the clamping plane, wherein each supporting block is symmetrical with respect to the clamping plane and comprising, between the protruding sections, a single central recess in which extend the bearing lugs of the chocks of both rolls, respectively upper and lower rolls, and each chock is fitted, on each side of the clamping plane, with a single lateral retaining face extending on the side opposite the clamping plane with respect to the back-up lug and sliding along a fixed guiding face arranged at the end of a corresponding protruding section of the supporting block.

Preferably, the bearing lugs of each chock are offset towards the clamping plane with respect to the axis of the corresponding roll so that the internal bearing faces of the positive bending jacks almost touch one another in the maximum wearing position of the working roll.

According to a preferred embodiment, the bearing sections of the lugs of a first chock and the free spaces of the lugs of the second chock are centred in a first diagonal plane running through the central axis of symmetry and in which are centred, respectively, two positive bending jacks and two negative bending jacks of the first chock and the bearing sections of the lugs of the second chock and the free spaces of the lugs of the first chock are centred on a second diagonal plane running through the central axis of symmetry and in which are centred two positive bending jacks and two negative bending jacks of the second chock.

According to another embodiment, each chock of a first working roll is fitted, on a first side of the clamping plane, with a first lug comprising a single bearing section centred on a medium plane of the chock running through the central axis of symmetry and on which bear, in opposite directions, a positive bending jack and a negative bending jack of the first roll, wherein the said single bearing section is surrounded by two free running spaces of the mobile elements of two positive bending jacks of the second working roll and, on the second side of the clamping plane, of a second lug in which is provided a free central running space of the mobile element of a positive bending jack of the second working roll, centred on the medium plane of the chock, wherein the central free space is surrounded by two bearing sections, respectively, of two positive bending jacks and of two negative bending jacks of the first working roll.

The invention applies to the new roll mill stands, but it is advantageous too for the modernisation of existing stands, for which the size stresses of the stanchions and of the existing chocks of the bearing rolls may complicate or compromise the installation of a clamping system of conventional design.

The invention also covers other characteristics that will appear in the following description of certain particular embodiments, given for exemplification purposes and represented on the appended drawings on which:

Figure 1:
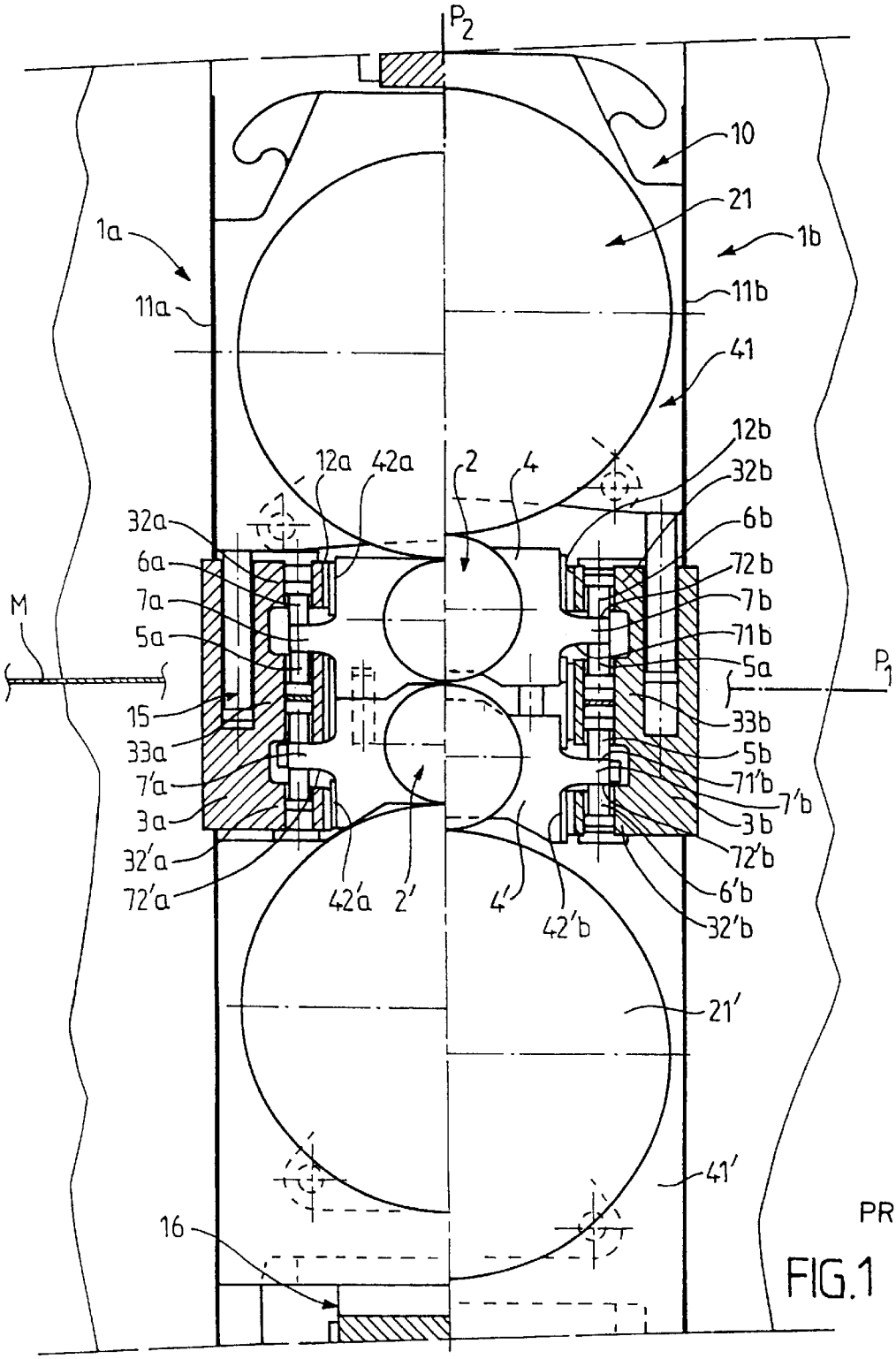
PRIOR ART FIG.1
FIG. 1 is a cross section of the central section of a quarto roll mill stand of known type.

FIG. 1 represents as a cross section the conventional arrangement of a quarto-type roll mill comprising, inside a stand having two distant stanchions 1, two working, respectively upper 2 and lower 2' rolls, which bear, respectively, on two back-up, upper 21 and lower 21' rolls and delineate a rectangular space for the passage of a band M to be rolled, running along a rolling plane P1.

FIG. 1 represents the central section of a window 1 of the stand, as a cross section to the axis of the rolls, wherein the second stanchion is identical.

Each working roll 2, 2' is mounted to rotate, at its ends, on journals revolving in bearings located in chocks 4, 4'. Similarly, the back up rolls 21, 21' are carried by chocks 41, 41'.

The axes of the rolls are parallel and must be held more or less in a clamping plane P2 perpendicular to the rolling plane P1. Usually, the latter is horizontal and the clamping plane P2 is more or less vertical.

In the rolling position represented on FIG. 1, in order to adjust the rolling plane, the rolls are tight and their levels may vary in relation of their degree of wear. For exemplification purposes, the half-view on the right represents the relative positions of the new rolls and the half-view on the left represents the positions of the worn rolls of smaller diameter.

It is therefore necessary to be able to adjust the relative levels of the rolls and the chocks are therefore mounted inside a window 10 of the stanchion 1 of the stand and may slide parallel to the clamping plane P2.

The chocks 41, 41' of the back-up rolls 21, 21' of larger diameter, are mounted to slide along guiding faces 11*a*, 11*b* provided directly along two stanchions 1*a*, 1*b* surrounding the window 10 of the stanchion 1.

However, the chocks 4, 4' of the working rolls 2, 2' of smaller diameter are narrower than the chocks 41, 41' of the back-up rolls 21, 21' and their guiding faces must therefore be closer to one another. Thus, according to a conventional arrangement, the guiding faces 12*a*, 12*b* of the working chocks are provided on the opposite faces of two machined blocks 3*a*, 3*b* that are mounted respectively on both stanchions 1*a*, 1*b* of the stanchion and protruding to the inside of the window 10.

It is advantageous in a roll mill to maintain the rolling plane P1 at more or less constant level, in particular when the band to be rolled M runs in succession through several rolls operating in tandem.

In the example represented on FIG. 1, to adjust the level of the rolling plane, shims 16 are adjusted in height using wedges or jacks, which are placed on the lower bottom of each stanchion 1 of the stand and on which bear the chocks 41' of the lower back-up roll 21'; the level of the lower shims 16 is adjusted in relation to the diameters of the rolls so that, taking into account the diameter of the lower working roll 2', the upper generatrix of the latter is located more or less at the level of the rolling plane P1.

The level of the upper back-up roll 2 is adjusted by clamping means, not represented, such as screws or jacks, which are installed at the upper section of both stanchions 1 of the stand to bear upon chocks 41 and that enable, besides, applying the required rolling strength to the reduced thickness.

Obviously, other arrangements may be used to adjust the relative levels of the rolls inside the stand.

As indicated, the rolls, in particular, the working rolls must be removed periodically from the stand for maintenance or replacement and, to this end, their chocks run or slide on fixed guiding rails. These rails (not represented on the figure) are installed on the stanchions of the stand and placed at constant level for which all the rolls are spread apart from one another. In order to place the rolls in replacement position, the lower back-up roll 21' is lowered to its lower level using lower shims and the upper back-up roll 21 is raised to its upper level using clamping means and, possibly, auxiliary jacks 15 mounted in the supporting blocks 3*a*, 3*b* and bearing upon the chocks 41 of the upper back-up roll 21. In operation, these jacks 15 also serve to balance the weight of the roll 21 and of its chocks 41.

Whereby the back-up rolls are spread apart by a wide opening, the relative levels of the working rolls 2, 2' can be adjusted by jacks located in the supporting blocks 3*a*, 3*b*. In the way stated above, these jacks also serve, in operation, to apply bending loads, respectively positive or negative, to the chocks of the working rolls.

FIG. 1 represents the most conventional arrangement in which each chock 4, 4' is connected to two sets of jacks placed respectively on either side of the clamping plane P2 and comprising, for each working roll, respectively upper 2 and lower 2', at least one positive bending jack 5, 5' and at least one negative bending jack 6, 6'.

Usually, these jacks act on bearing parts provided on either side of each chock and which form opposite lugs 7, 7', each extending and protruding with respect to the corresponding lateral side 42 of the chock.

Consequently, each supporting block 3 is E-shaped comprising three protruding retaining sections, respectively an upper section 32, a central section 33 and a lower section 32', which surround two recesses, respectively upper 31 and lower 31', inside which extend the lugs 7, 7' of the working chocks, respectively upper 4 and lower 4'. The bending jacks bearing on the lugs of the chocks are located in these three protruding sections whose opposite ends from the guiding faces 12*a*, 12*b* along which slide the lateral sides 42*a*, 42*b*, 42'*a*, 42'*b*, of both chocks 4, 4'.

Thus, both positive bending jacks, respectively 5 of the upper working roll 2 and 5' of the lower working roll 2', are located in the central section 33 of the supporting block 3 and bear, respectively, on the internal faces 71, 71', turned toward the rolling plane P1, of the lugs 7, 7', of both working chocks 4, 4'. The negative bending jacks 6, 6' are located, respectively, in the upper protruding section 32 and in the lower protruding section 32' of each supporting block 3 and bear on the external faces 72, 72' of the lugs 7, 7' of both chocks 4, 4', turned opposite to the rolling plane P1.

As can be seen on FIG. 1, in order to accommodate the positive bending jacks 5, 5' in the central section 33 with the stroke necessary to the level adjustments of the working rolls, it is necessary to make the central bearing section 33 of the supporting block 3 relatively thick, the end 34 of the block must form a guiding face having a sufficient height for the corresponding lateral sides of the chocks 4, 4'.

Besides, in the tight position of the working rolls represented on the left half-view and for which the worn rolls have the smallest diameter, both chocks 4, 4' practically touch one another. Sizing the various sections of the supporting blocks 3 and the working chocks must therefore take into account the wearing range, in particular when the rolling plane should be maintained at constant level. For instance, in the stand represented on FIG. 1, the lower face 43 of the chock 4 is located below the rolling plane in the maximum wearing position.

These different requirements complicate the implementation of the bending means in the stand and lead, most often, to asymmetrical arrangement with respect to the rolling plane, whereas the chocks are necessarily different for both working rolls.

As can be seen now, the invention enables avoiding such shortcomings and simplifying the integration of hydraulic blocks.

Figure 2:
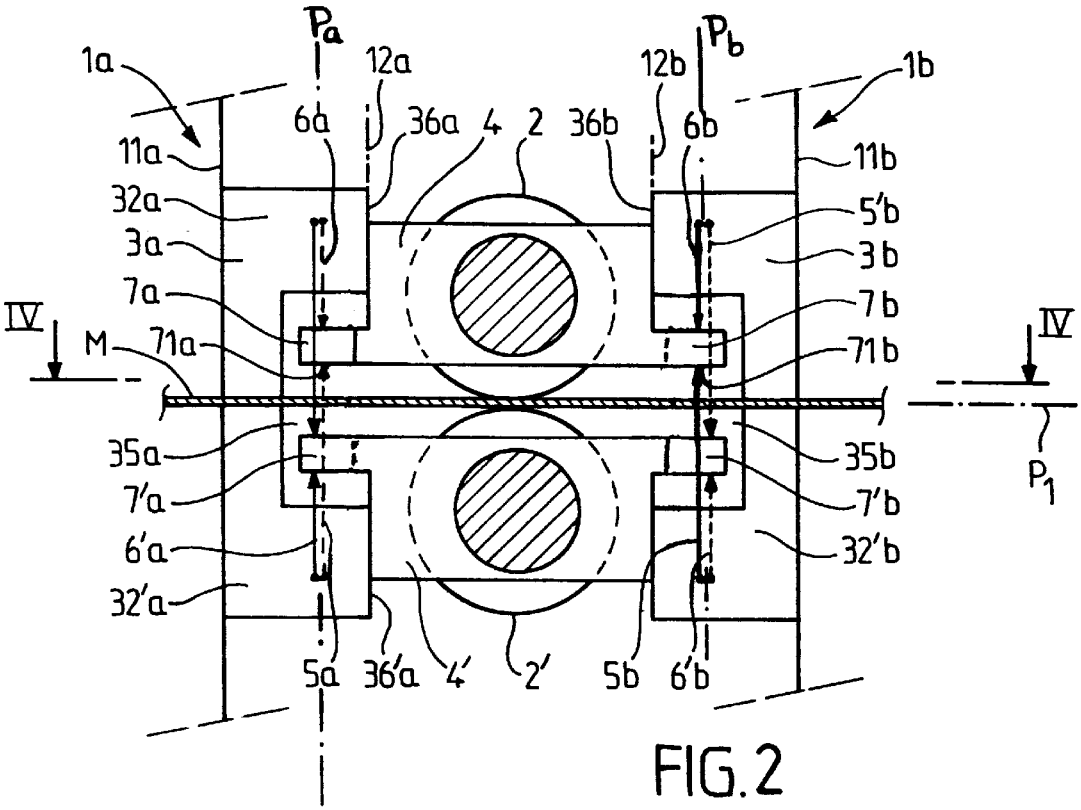
FIG. 2 is a principle diagram of the arrangement according to the invention, of the chocks and of bending jacks of the working rolls of the present invention.
Figure 3:
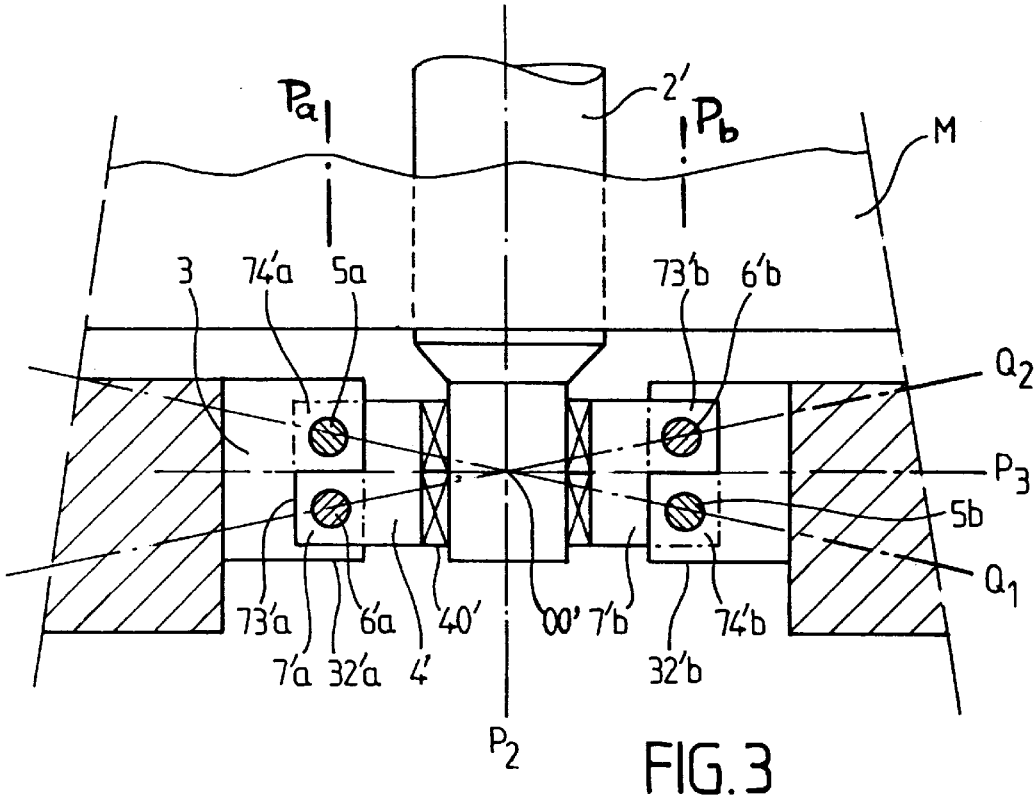
FIG. 3 is a principle diagram, a top view along the line III—III of FIG. 2.
Figure 6:
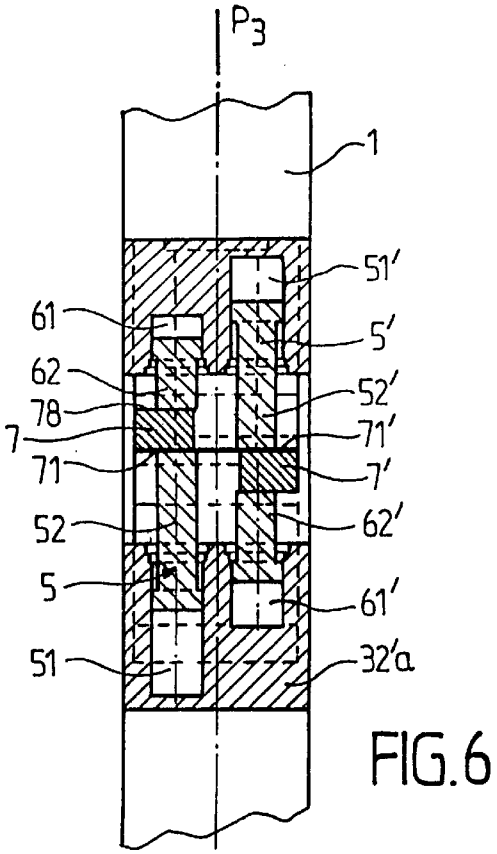
FIG. 6 is a cross section along the line VI—VI of FIG. 5.
Figure 5:
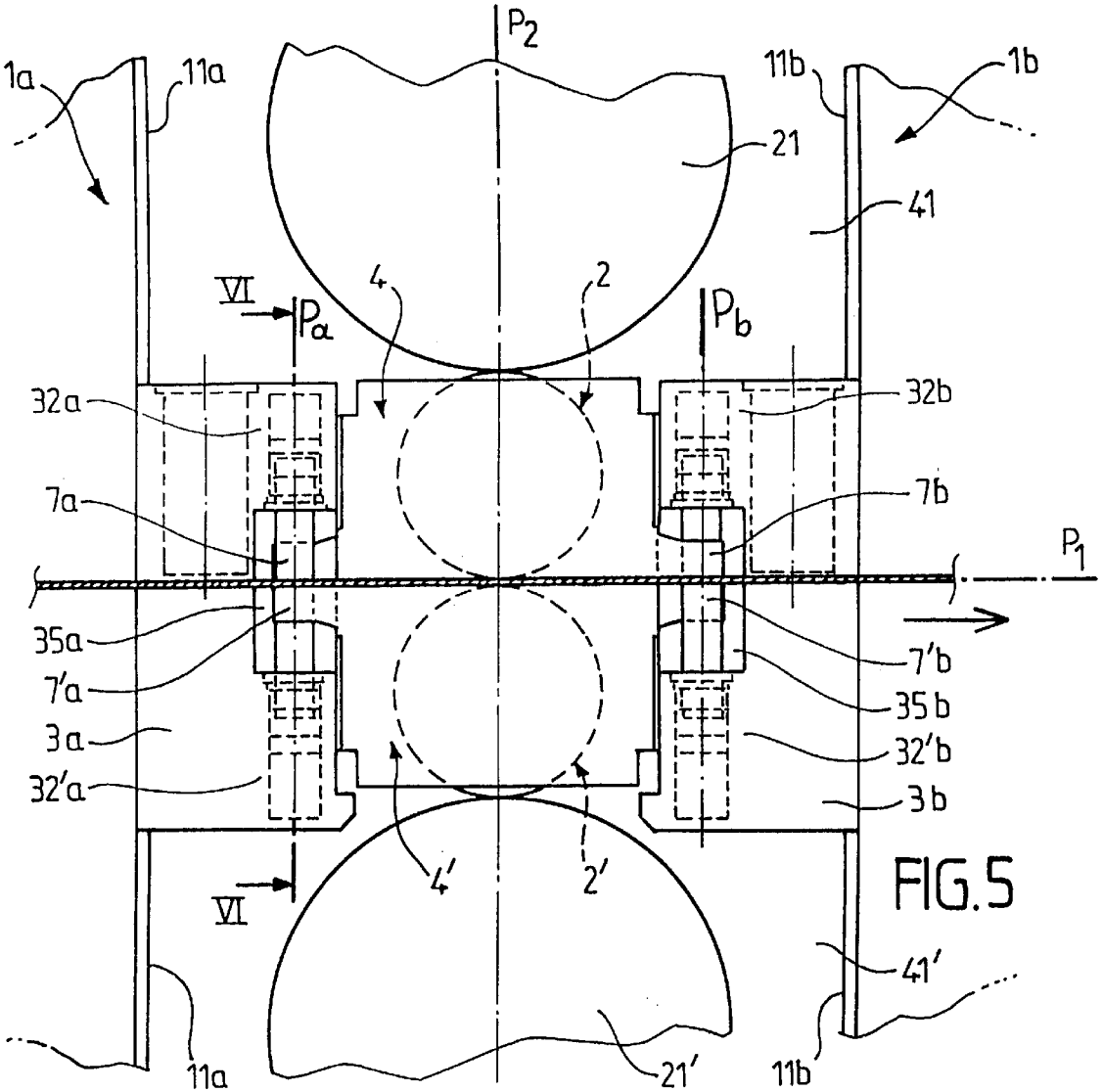
FIG. 5 is a partial side view of the working chocks, according to a preferred embodiment.

The principle of the invention is represented schematically on FIGS. 2 and 3 and more in detail on FIGS. 5 and 6.

The invention is described, for exemplification purposes, in the case of quarto-type roll mill such as represented on FIG. 1 and therefore comprising all the usual arrangements. FIGS. 2 and 3 only represent automatically both stanchions 1*a*, 1*b* of the stanchion between which are arranged both working rolls 2, 2' which are carried by chocks 4, 4' mounted to slide between supporting blocks 3*a*, 3*b*.

As can be seen on FIG. 2, each supporting block 3*a*, 3*b* comprises a single recess 35*a*, 35*b* extending on either side of the rolling plane P1, whereas the central section 33 of the known arrangement has been eliminated. Thus, in cross section each supporting block has a C-shaped and not an E-shaped profile.

It results that in each supporting block 3, the bending jacks must all be located in two bearing sections, respectively upper 32 and lower 32' surrounding a central recess 35. The arrangement of the negative bending jacks 6, 6' remains unchanged but, conversely, each positive bending jack 5, 5' must necessarily be located in the retaining and protruding section of the supporting block that is placed on the side opposite the chock on which it must act, with respect to the rolling plane P1.

It is why the positive bending jacks 5*a*, 5*b* bear upon the internal faces 71*a*, 71*b* of both lugs 7*a*, 7*b* of the upper chock 4 are located in the lower protruding sections 32'*a*, 32'*b* of the supporting blocks 3*a*, 3*b* with the negative bending jacks 6'*a*, 6'*b* of the lower chock 4'.

Consequently, the body 51 of each positive bending jack 5 must be placed beside the body 61' of the negative bending jack 6', in the lower protruding section 32' and the stem 52 of the jack 5 must go through the lug 7' of the lower chock 4' to run to the other side of the rolling plane P1 and bear upon the internal face 71 of the lug 7 of the upper working chock 4.

Moreover, so as not to increase the degree of cantilever of the protruding sections 32, the bending jacks are placed one beside the other and centred, respectively in two planes Pa, Pb parallel to the clamping plane P2 and spaced symmetrically on either side of this plane.

FIG. 3 shows schematically an embodiment of the lugs of the chocks that enable obtaining this result. It can be seen that, on each side of the chock, the bending jacks, respectively, positive 5 and negative 6' are placed beside one another and offset axially, respectively on either side of the medium plane P3 of the chock 4' on which are centred the rotary supporting bearings 40' of the working roll 2'. Each lug 7' of the chock exhibits therefore a staggered profile comprising a bearing section 73' of the negative bending jack 6' extending over a portion only of the length of the chock, in the longitudinal direction of the axis of the roll, in order to leave a free space 74' enabling the stem of the positive bending jack 5 to run through.

Moreover, this arrangement is reverted, on the one hand between the opposite sides of the same chock 4', on either side of the clamping plane P2 and, on the other hand, between the same sides of the two chocks respectively lower 4' and upper 4, placed on either side of the rolling plane P1.

For example, it can be seen on FIG. 3 that the lug 7'*a* of the lower chock 4' on the left of the clamping plane P2 exhibits a staggered profile comprising a bearing part 73'*a* of the negative bending jack 6'*a* that is placed in front of the medium plane P3 of the bearings and extending moreover over half the length (L) of the chock, in order to leave a free space 74'*a* placed behind the same medium plane P3, for the stem of the positive bending jack 5*a* of the upper chock 4. Conversely, the lug 7'*b* of the lower chock 4' placed on the right of the clamping plane P2 exhibits a reverted staggered profile comprising a bearing section 73'*b* of the negative bending jack 6'*b*, which is placed behind the medium plane P3 and leaves a free space 74'b in front of the same medium plane P3 for the passage of the stem of the positive bending jack 5b of the upper chock 4.

In the preferred embodiment represented on FIGS. 5 and 6, the bodies 51, 61 of the various jacks, that are single action jacks, can simply consist of bores provided in opposite angles of the corresponding protruding sections 32, 32' of the supporting blocks 3. FIG. 6, which is a cross section through a plane running through the axes of the jacks, of the supporting block 3a placed on the left of the clamping plane P1 on FIG. 5, shows that the lower retaining section 32' of the block 3a comprises two bores placed close to one another, respectively 61' forming the body of the negative bending jack 6' and 51 forming the body of the positive bending jack 5 of the upper chock 4.

As indicated on FIG. 3, the positive bending jacks 5a, 5b of the upper working roll 2 are thus placed in two opposite angles of the lower retaining sections 32'a, 32'b of both supporting blocks 3a, 3b and are therefore centred on a first tilted diagonal plane Q1 of a non-right angle with respect to the clamping plane P2. The same goes for free spaces 74'a, 74'b provided in the lugs 7'a, 7'b of the lower chock 4'. Consequently, the negative bending jacks 6'a, 6'b of the lower working roll 2' are placed on either side of the plane P2, in both other angles of the retaining sections 32'a, 32'b of both supporting blocks 3a, 3b and are centred in a second diagonal plane Q2, as well as the bearing parts 73'a, 73'b of both lugs 7'a, 7'b.

Figure 4:
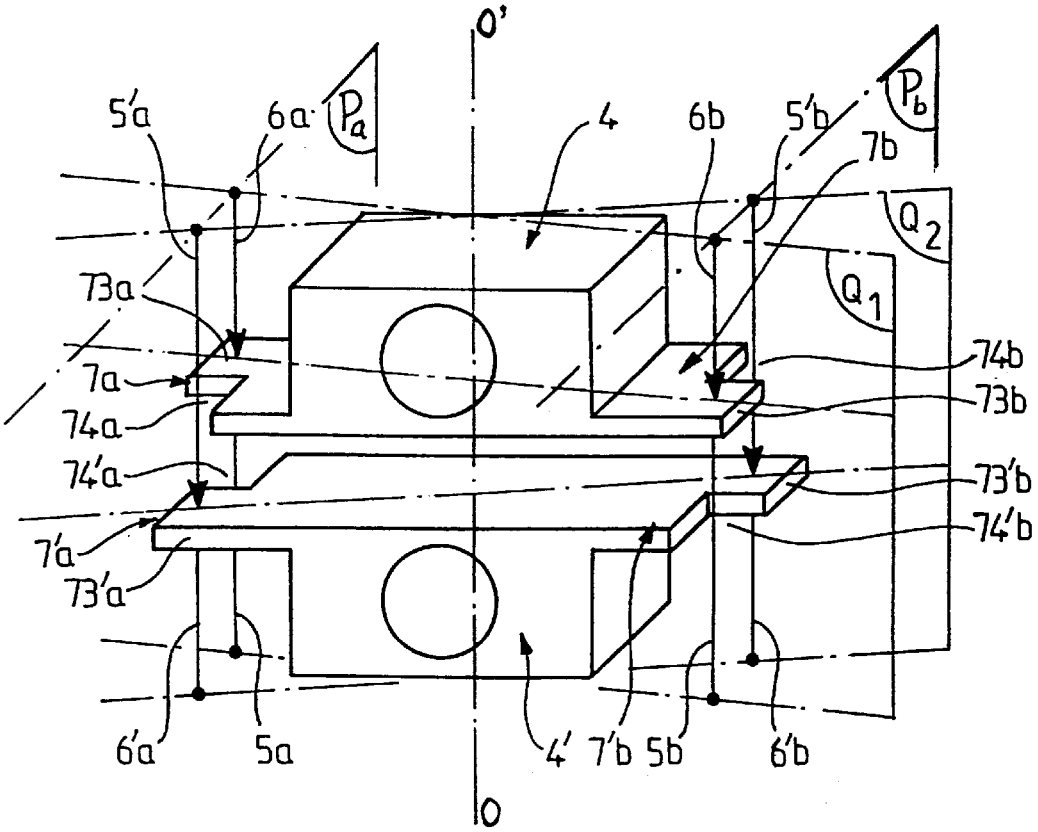
FIG. 4 shows schematically, in perspective, the arrangement of the bending jacks.

On FIG. 4 which shows schematically, in perspective, the assembly comprising both chocks 4, 4', it can be seen that the arrangement is reverted for the upper working chock 4 and for the jacks located in the upper retaining sections 32a, 32b of the supporting blocks 3a, 3b; the positive bending jacks 5'a, 5'b of the lower roll 2' are centred in the second diagonal plane Q2 whereas the negative bending jacks 6a, 6b of the upper working roll 2 are centred in the first diagonal plane Q1.

The whole arrangement comprises therefore a central axis of symmetry OO' placed at the intersection of the clamping plane P2 with the medium plane P3 of the chocks and through which run both diagonal planes Q1 and Q2.

Consequently, although the bending jacks acting on two opposite lugs of a chock are staggered axially on either side of the medium plane P3, the bending action exerted on the chock remains centred correctly with respect to the bearing, in positive direction as well as in negative direction.

The arrangement represented on Figures is particularly simple and can be adapted easily to an existing stand. Other arrangements could therefore be contemplated, enabling passing the resultant of the bending loads exerted in positive or negative direction through the centre of the chock. In particular, the bending load could be applied on either side of the chock by a larger number of jacks arranged in order to ensure centring the resultant of the loads applied.

Figure 7:
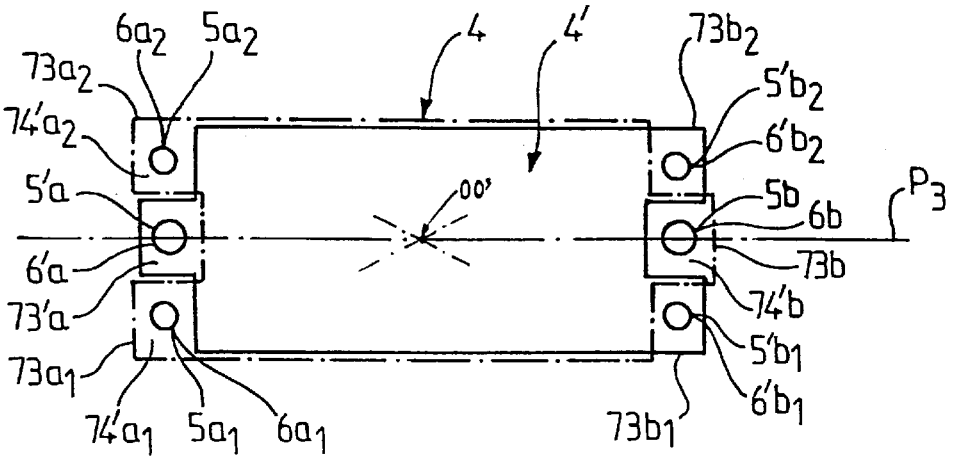
FIG. 7 is a top schematic view of another embodiment.

For exemplification purposes, FIG. 7 shows another arrangement in which the bending load is applied to one side of the chock by a single jack and to the other by two jacks power-supplied in parallel. In such a case, each lug of a chock exhibits a staggered profile with two free spaces on either side of a bearing part or two bearing parts on either side of a free space. Thus, the lug 7'a of the lower working chock 4', placed on the left of the clamping plane P2, comprises a bearing part 73'a which is centred on the medium plane P3 of the bearings, on which bear the positive 5'a and negative 6'a bending jacks. This bearing part 73'a is surrounded by two free spaces 74'$a_1$, 74'$a_2$ in which pass the stems of both positive working jacks 5$a_1$, 5$a_2$ of the upper working roll which are power-supplied in parallel. On the right side of the clamping plane P2, the lug 7'b comprises two bearing parts 73'$b_1$, 73'$b_2$ spaced symmetrically on either side of the medium plane P3, upon which bear two pairs of jacks operating in parallel, respectively 5'$b_1$, 5'$b_2$ positive bending jacks and 6'$b_1$, 6'$b_2$ negative bending jacks of the lower roll 2'. Between both these bearing parts 73'$b_1$, 73'$b_2$ is placed a central recess 74'b for the passage of the stem of the positive bending jack 5b of the upper chock 4.

The bearing lugs 7a, 7b of the upper working chock 7 represented in mixed line on FIG. 7 are arranged in reverse and therefore comprise, on the left, two bearing parts 73$a_1$, 73$a_2$ of both positive bending jacks 5$a_1$, 5$a_2$ and, on the right, a bearing part 73b surrounded by two free spaces 73$b_1$, 73$b_2$ for passing the stems of the positive bending jacks 5'$b_1$, 5'$b_2$ of the lower roll 2'.

Thus, the bending loads applied to each chock, in positive direction or in negative direction have a resultant directed along the central axis of symmetry 10 passing through the centre of each bearing.

Since the bearing lugs 7, 7' of both chocks 4, 4' extend inside the same central recess 35 of each supporting block 3, the lateral retaining faces 42, 42' of each chock 4, 4' extend on a single side of the lug 7, 7' in order to slide along the guiding faces 36, 36' provided at the ends of the protruding retaining sections 32, 32'. Consequently, both chocks can be symmetrical with respect to the rolling plane P1. Thus, identical chocks can be used for identical chocks for both working rolls, whereas the chock is simply turned over by 180° according to whether the chock is placed above or beneath the rolling plane P1.

It should be noted that, to enable dismantling of the rolls, the stems of the jacks must be retracted completely in order to clear the central recess 35 entirely. Consequently, as shown on FIGS. 5 and 6, the height of each retaining section, respectively upper 32 or lower 32' section, of a supporting block 3 is determined in relation to the stroke of the positive bending jack which depends itself on the length that can be given to the stem of the jack so that it bears upon the lug of the chock placed on the other side of the rolling plane P1, whereas the jacks of the negative bending jacks have a lower stroke.

The invention advantageously enables reducing the global height of each supporting block in relation to the usual arrangement since the chocks are symmetrical and the central protruding section, which was necessary in the past, in order to accommodate the positive bending jacks, is eliminated. There results a reduced height of the zone that must remain available between the chocks 41, 41' of the back-up rolls to enable integrating the supporting blocks. This arrangement is particularly interesting in the case of modernisation of an existing roll stand since it enables facilitating the integration of the positive and negative bending system between the back-up rolls without any significant modification of the stand stanchions.

Besides, since the back-up faces 42 extend on a single side of the lugs 7, the lugs can be brought as close as possible to the rolling plane, which enables reducing to the minimum necessary the length of the stems 52 of the positive bending jacks. The internal faces 71a, 71b of both lugs 7a, 7b are then placed more or less at the level of the internal face 43 of the chock 4 turned to the rolling plane. The chock is spaced itself from the axis of the roll over a distance slightly less than the smaller radius of the working roll 2. Thus, when the rolls show a maximum degree of wear, the internal faces 71, 71' of the lugs 7, 7' of both chocks 4, 4' almost touching one another, in the rolling plane P1, taking into account the necessary adjustments for negative bending.

But the invention exhibits other advantages.

For example, the number of fixed guiding faces and of lateral retaining faces of the chocks is reduced. Still, we know that the sliding faces must be fitted with parts made of a material whose friction coefficient is suited to the usage and which form wearing parts. Reducing their number, by adopting the set of arrangement according to the invention, enables decreasing the cost of installation as well as the production costs while simplifying the maintenance operations and while cutting the time necessary to the interventions.

Besides we know that in a tandem roll mill, the rolling plane should be maintained at a more or less constant level.

Thanks to the invention, since the global height of the hydraulic blocks and of the chocks is smaller, it is possible to provide without any difficulties the necessary adjustment ranges and to use supporting blocks of the same height and, even identical, for all the stands.

Obviously, the invention is not limited to the details of the embodiments that have been described for exemplification purposes only, whereas other equivalent arrangement can be contemplated without departing from the protection framework defined in the claims. In particular, inasmuch as the positive and negative bending jacks can be placed in the same supporting blocks, it is advantageous to use, as described previously, single jacks simply offset with respect to the medium plane of the chock, but other arrangements are possible while using a larger number of jacks arranged in the bearing sections so that the resultant of the loads always runs through the centre of the chock.

Besides, the invention has been described in the case of a quarto roll mill, but could be applied to any type of roll mill, for instance quinto or sexto, every time it is useful to curve the working rolls.

The reference signs inserted after the technical characteristics mentioned in the claims solely aim at facilitating the understanding thereof and do not limit their extent in any way.

What is claimed is:

1. A roll mill comprising:

a retaining stand with two distant stanchions, each stanchion comprising a window with two sides, a set of rolls comprising at least two working rolls with two parallel axes of rotation placed in a substantially vertical clamping plane, said working rolls delineating a space for passing a product along a substantially horizontal rolling plane, each of said at least two working rolls having two ends rotating respectively in two chocks, each chock including a bearing having a medium plane perpendicular to an axis of rotation of the roll, said two chocks being mounted respectively, in said windows of the stanchions of the stand, and each chock having, on either side of the clamping plane, lateral retaining faces sliding along fixed guiding faces parallel to the clamping plane, each chock being provided, on each side, with a lug protruding to the outside with respect to the corresponding lateral retaining face of the chock, each lug having an internal bearing face directed toward the rolling plane and an external bearing face directed toward the opposite side, means for applying bending loads to each end of both said at least two working rolls comprising, on either side of the clamping plane, two sets of bending jacks, each set being provided on a side of the rolling plane, each set including at least two positive bending jacks bearing, respectively, on internal faces of the lugs of both chocks and a set of at least two negative bending jacks bearing, respectively, on external faces of the lugs of both chocks, each bending jack having one fixed element and one mobile element, said bending jacks of both chocks being centered respectively in two planes parallel to the clamping plane, each lug of each chock having a staggered profile comprising at least one bearing part and at least one free space, wherein, on at least one side of the clamping plane, one lug of one of said two chocks placed on one side of the rolling plane is provided with one single bearing part which is centered on the medium plane of the bearing of said one chock and two free spaces on either side of said single bearing part, and the facing lug of the other of said two chocks placed on the other side of the rolling plane is provided with one single free space which is centered on the medium plane of the bearing of said other chock and two bearing parts on either side of said single free space, said one chock being associated with one positive bending jack and one negative bending jack bearing respectively on internal and external faces of the single bearing part of the one lug, the mobile element of said one positive bending jack crossing the rolling plane and passing through the single free space of the facing lug of said other chock, and said other chock being associated with two positive bending jacks and two negative bending jacks bearing respectively on the internal and external faces of the two bearing parts of the facing lug, the mobile elements of said two positive bending jacks passing in the two free spaces of the one lug of said one chock.

2. The roll mill according to claim 1, wherein said chocks are identical and are capable, by simple turning-over, to be mounted on either of the working rolls.

3. The roll mill according to claim 1, wherein, on one side of the clamping plane, one lug of one of said two chocks placed on one side of the rolling plane is provided with one single bearing part which is centered on the medium plane of the bearing of said one chock and two free spaces on either side of said single bearing part, and the facing lug of the other of said two chocks is provided with one single free space which is centered on the medium plane of the bearing of said other chock and two bearing parts on either side of said single free space, said one chock being associated with one positive bending jack and one negative bending jack bearing respectively on internal and external faces of the single bearing part of the one lug, the mobile element of said one positive bending jack crossing the rolling plane and passing through the single free space of the facing lug of said other chock, and said other chock being associated with two positive bending jacks and two negative bending jacks bearing respectively on the internal and external faces of the two bearing parts of the facing lug, the mobile elements of said two positive bending jacks passing in the two free spaces of the one lug of said one chock; and wherein, on the other side of the clamping plane, the other lug of said other chock is provided with one single bearing part which is centered on the medium plane of the bearing of said other chock and two free spaces on either side of said single bearing part, and the facing other lug of said one chock is provided with one single free space which is centered on the medium plane of the bearing of said one chock and two bearing parts on either side of said single free space of the facing other lug, said other lug of said other chock being associated with one positive bending jack and one negative bending jack bearing respectively on internal and external faces of the single bearing part of said other lug, the mobile element of said one positive bending jack crossing the rolling plane and passing through the single free space of the facing other lug of said one chock, and said facing other lug of said one chock being associated with two positive bending jacks and two negative bending jacks bearing respectively on the internal and external faces of the two bearing parts of said facing other lug of said one chock, the mobile elements of said two positive bending jacks passing in the two free spaces of the other lug of said other chock.

4. The roll mill according to claim 1, applicable to a rolling installation, comprising at least two tandem-operating stands, wherein the chocks of the working rolls are all identical.

* * * * *